United States Patent [19]

Scaglia

[11] 4,014,082

[45] Mar. 29, 1977

[54] METHOD AND EQUIPMENT FOR REMOVING REELING WASTE

[75] Inventor: Mario Scaglia, Milan, Italy

[73] Assignee: M. Scaglia S.p.A., Italy

[22] Filed: Dec. 19, 1975

[21] Appl. No.: 642,383

[30] Foreign Application Priority Data

Dec. 19, 1974 Italy ..... 30754/74
Sept. 17, 1975 Italy ..... 27308/75

[52] U.S. Cl. ..... 28/20; 28/72 R
[51] Int. Cl.[2] ..... D03D 45/58
[58] Field of Search ..... 28/19, 20, 72 R

[56] References Cited

UNITED STATES PATENTS

| | | | |
|---|---|---|---|
| 1,319,202 | 10/1919 | Boye | 28/20 |
| 2,183,863 | 12/1939 | Donahoo | 28/19 |
| 3,092,889 | 6/1963 | Hayes | 28/19 |
| 3,095,631 | 7/1963 | Rohl | 28/20 |

*Primary Examiner*—Louis K. Rimrodt
*Attorney, Agent, or Firm*—McGlew and Tuttle

[57] ABSTRACT

In the method and equipment, the yarn support outer surface is drawn by means of a suitably sized die ring adapted to retain and slide the reeling waste all along the yarn support outer surface and strip the reeling waste therefrom. Suitable cutters operate on reeling waste, before the drawing thereof, in order to reduce the volume of reeling waste to be drawn and stripped.

20 Claims, 5 Drawing Figures

METHOD AND EQUIPMENT FOR REMOVING REELING WASTE

BACKGROUND OF THE INVENTION

1. FIELD OF THE INVENTION

This invention relates to a method for removing yarn residues on yarn supports, e.g. pirns, spools, bobbins, reels and the like, as well as an equipment for carrying out the method.

2. DESCRIPTION OF THE PRIOR ART

A major problem in the textile industry is that pertaining to the re-utilization of yarn supports, which are to be fully cleaned from yard residues (or so called "reeling waste") left thereon after each running out of a spool, before they can be re-utilized for a further winding operation.

The already known reeling waste removal methods involve the utilization of a heat source, or of suitable cutting means. However these methods all show restrictions, owing to the materials of the yarn supports or to the types of yarns wound thereon. In particular, a heat source, e.g. a hot air blast at a given temperature, can be used only when synthetic yarns, wound on supports which cannot be damaged by such high temperatures, are involved. Similarly, the cutting of reeling waste by a mechanically acting blade, or possibly by a heated blade, necessarily requires the use of yarn supports made of hard materials, or at any rate having a surface which cannot be indented by a blade or other similar means.

SUMMARY OF THE INVENTION

Accordingly, an object of this invention is to provide a method for mechanically removing reeling waste, by which waste can be always quickly, reliably and fully removed, thus wholly cleaning the outer surface of yarn supports. Such method is characterized in that a positive axial motion is imparted to a yarn support relative to a die ring surrounding the support and having an inner diameter corresponding to the yarn support outer diameter, in order to retain, by its fore inner edge, all reeling waste that is thus caused to slide along the yarn support outer surface, the rear end thereof.

The equipment for carrying out the method is characterized in that it comprises: means for retaining, centering and removably fastening a yarn support, and acting thereon in a manner non-interfering with the outer support surface, whereon the reeling waste is wound; a die ring having an inner diameter corresponding to the yarn support outer diameter, and means to impart a relative, positive axial motion to the die ring relative to the retaining and fastening means, in order to cause the die ring fore inner edge to slide along the yarn support outer surface, with a slipping contact as required, to slide the reeling waste therealong and to bring the same to the yarn support rear end.

DESCRIPTION OF THE PREFERRED EMBODIMENTS

As previously stated, this invention aims to solve the problem of removing the so called reeling waste from yarn supports, as e.g. pirns, spools, bobbins, reels and the like, in order to allow for a re-use thereof, whatever the material of the yarns and supports may be, i.e. even when the yarn cannot be thermally cut, and/or when yarn supports which can be damaged by a thermal or mechanical yarn cutting action are used. According to this invention this problem is essentially solved by subjecting the yarn supports, carrying yarn residues or reeling waste, to a so called drawing action, in order to cause yarn residues to be moved along the support outer surface to the end thereof, without exerting any mechanical or thermal action that could result in damage of such surface.

Figure 1:
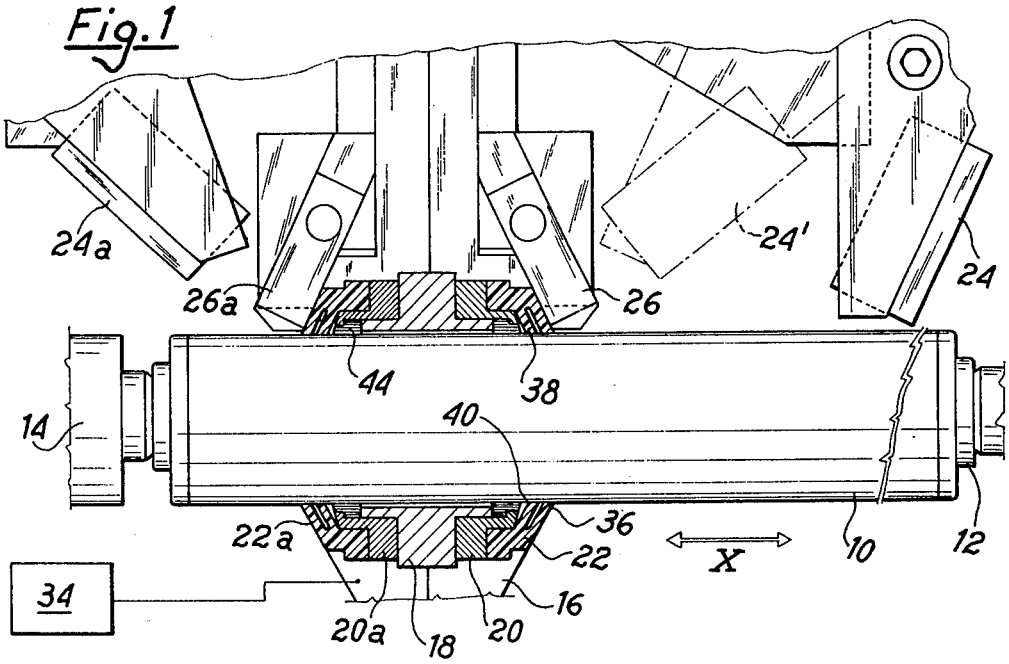
FIG. 1 is a part sectional side view of an equipment for removing reeling waste in accordance with the principles of the invention, wherein the components not essential for the understanding of the invention have been omitted.

A preferred embodiment of an equipment for carrying out these principles is diagrammatically shown in FIG. 1.

The yarn support to be subjected to a reeling waste removing operation consists of a pirn 10, having a cylindric outer surface and made e.g. of a suitable plastics. The equipment for removing yarn residues left on the outer surface of the yarn support or pirn 10 essentially comprises means for fastening the pirn without interfering with the outer surface thereof; means by which a relative motion is imparted to the pirn relative to a die ring; as well as a die ring acting upon the outer surface of pirn 10.

In particular, pirn 10 is supported by two fastening and centering elements 12 and 14, acting on opposite ends thereof and consisting of cone-shaped components, that are inserted and forced into pirn end openings, at least one of the fastening and centering elements 12 and 14 being controllably movable in an axial direction to place the yarn support to be cleaned in a required operative position, and, respectively, to remove the support, after having been wholly cleaned from the reeling waste.

The reeling waste removal is performed by a die ring, surrounding the outer surface of pirn 10 in contact therewith, and moved axially substitute thereto. Referring to the drawings, the equipment comprises a main support 16 with which an auxiliary support 18, 20 is associated, by which the proper die ring is supported, along with cutting means, designed to act in advance upon the reeling waste, without coming into contact with the outer surface of pirn 10.

The cutting means consist of two blades acting in sequence, i.e. a roughing blade 24 and a finishing blade 26, aligned with each other and obviously located at different distances from the outer surface of pirn 10. The roughing blade 24 can be controlledly moved to its inoperative position 24' for a reason which will be explained later on, and moreover it is placed at an axial distance, upstream of finishing blade 26, critically ranging from 60 up to 150 mm, and preferably of an order of 100 mm, to ensure the best operative conditions in the cutting of reeling waste.

The finishing blade 26 is formed with three cutting edges (as shown by thicker lines in FIGS. 2 and 3) namely: a fore cutting edge 28 by which the reeling waste is first cut; a cutting edge 30 parallel to the outer surface of pirn 10 and cooperating with the leading cutting edge 28, in particular when cutting edge 28 is becoming dull, and finally a rearwardly directed (i.e. toward the die ring 22) cutting edge 32 that cuts the yarn loops which are formed directly upstream of the die ring, owing to the drawing operation, and that might seriously hinder the drawing operation, above all near the end of pirn 10.

As shown in the drawing, the equipment comprises two symmetrically arranged die rings 22 and 22*a*, with supports 20, 20*a* and related cutting means 24, 24*a* and 26, 26*a*, the whole being driven axially e.g. by means of cylinder-piston set, generally indicated at 34. Such a symmetrical arrangement allows the performance of a reeling waste removal operation in each operative reciprocating motion of the equipment—obviously by replacing the already cleaned yarn support by a yarn support to be cleaned at the end of each operative reciprocating motion, and acting with the component set 20,22,24,26 during the forward stroke (from the left to the right), and with the component set 20*a*, 22*a*, 24*a*, 26*a* during the return stroke (from the right to the left). Thus, a greater machine efficiency is attained and, notwithstanding the presence of roughing blades 24, 24*a* the operative stroke of the cylinder-piston set 34 can be limited, due to the possibility of bringing the blades into said inoperative position while the pirn is being replaced and then lowering the related blade onto a point of the pirn already spaced from its head, due to the fact that the height of reeling waste is gradually reduced at the pirn ends.

The fore lip of the die ring 22 is kept in contact with the outer surface of pirn 10, in order to remove and retain, during the movement in the direction X, all yarn residues left on the outer surface, that obviously protrude therefrom. As can be readily appreciated, the inner diameter of the fore lip of the die ring 22 should exactly correspond to the outer diameter of the pirn 10 across the whole length thereof, while the die ring 22 should be made of a material such as to positively prevent any damage and in particular any scoring of the outer surface of pirn 10, while exerting thereon a pressure sufficient to ensure in each case a sliding removal of all yarn residues left on the pirn.

Accordingly, die ring 22 is preferably made of an elastomer having the required features relative to the material forming pirn 10 and imparting also a given elastic deformability to the die ring in order to follow possible irregularities of the outer surface of pirn 10.

In particular, die ring 22 is characterized in that it shows a fore lip 36 (see in particular FIGS. 2 and 3) forwardly sloping relative to a plane perpendicular to the axis of the yarn support 10, and separated from the die ring body by a notch 38, in order to allow displacements of fore lip 36 both in an axial direction and simultaneously in an approaching direction to the yarn support axis, under the action of drawing stresses, in order to take-up the wear, as well as any clearance or defect in the cylinderlike shape of the yarn support. Moreover, the die ring can be also formed with a second lip 40, connected with the ring body and likewise slanting relative to a rear support therefor. Accordingly, wear and clearance taking-up can occur not only by means of slanting fore lip 36, but also by a motion of all operative portions of die ring 22, as shown in FIG. 3 (wherein the clearance has been oversized for a better understanding).

Figure 2:
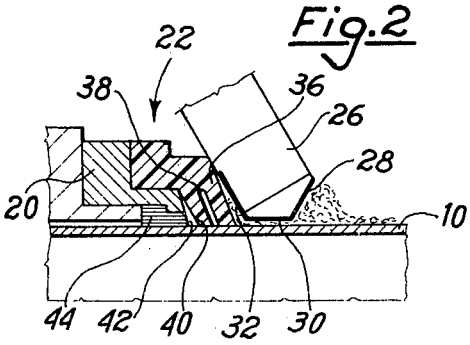
FIGS. 2 and 3 are part sectional views similar to that of FIG. 1 and diagrammatically showing the operation of reeling waste removal in two typical, practical cases, wherein the outer surface of a yarn support is perfectly cylindric and, respectively, slightly deformed.
Figure 3:
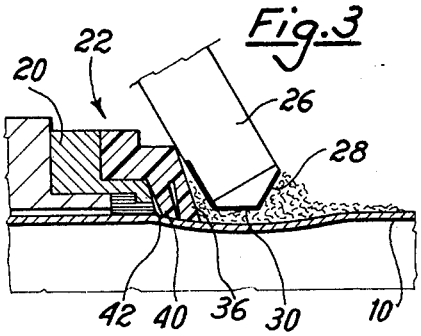

When comparing FIG. 3 with FIG. 2, a displacement of the whole die ring toward the yarn support can be shown, with consequent decrease of the die ring inner diameter 42, as well as with an approaching of fore lip 36 to rear lip 40, with a width reduction of the opening 38.

To the elastomer die ring 22 there is associated a guide 44, exactly sized as to yarn support 10 and acting upon the outer surface thereof, after it has been wholly cleaned from the reeling waste, in order to ensure an accurate centering of the yarn support with respect to the die ring. To prevent any damage to the outer surface of textile support 10, guide 44 is advantageously made of an antifriction material, e.g. polytetrafluoroethylene.

Figure 4:
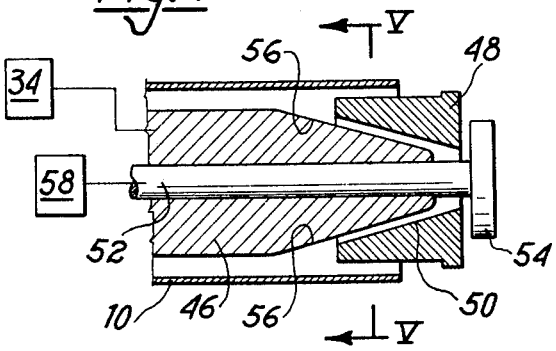
FIGS. 4 and 5 are a part-axial sectional view and, respectively, a cross sectional view taken on the plane V—V in FIG. 4, of an alternative embodiment of yarn support retaining and fastening means, as shown in a position taken directly before their fastening action.
Figure 5:
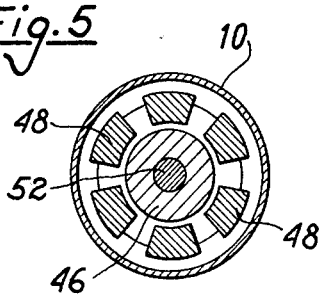

FIGS. 4 and 5 show a different embodiment of the supporting means for the pirn 10. In such a case the pirn is inserted into a support 46 until its fore end abuts against a rear shoulder (not shown) of support 46. Then, a row of wedges 48, having slanting surfaces 50 (see in particular FIG. 4) is pushed forwardly, e.g. by means of a rod 52 having a flange 54 at its fore end, in order to bring the slanting surfaces 50 into engagement with correspondingly slanting inner sides 56 of the support 46 and lock prin 10 on support 46 when wedges 48 are moved from their open position, as shown in FIG. 4, to their locking position. The rod 52 can be driven by a suitable device, e.g. a hydraulic device, diagrammatically shown at 58, which should be able to allow for a quick fastening and centering of pirn 10 into the support 46, as well as for a quick disengagement of the pirn at the end of reeling waste removal operation, while the drawing motion is controlled by acting on said support 46, as shown at 34.

The equipment can be operated at high speeds and with a great reliability without any danger of jammings or damage to their components, and ensuring a thorough cleaning of any yarn support 10, even in the case of wear of the cooperating components, or of clearance therebetween, e.g. due to size tolerances of yarn supports to be cleaned, or to the presence thereon of flattened portions, as formed by the yarn pressure onto the outer surface thereof.

To ensure tight engagement of the die ring with the yarn support, also when using slightly tapered yarn supports, die rings having an operative portion at least limitedly movable, e.g. elastically movable and urged or swollen by a suitable fluid (e.g. compressed air or pressure oil) into contact with the yarn support outer surface can also be used.

Obviously, many modifications and variations of the present invention are possible in the light of the above teachings. Therefore, it is to be understood that the invention is not limited to the details as specifically described or illustrated.

I claim:

1. A method for removing yarn residue and reeling waste, left on a relatively elongated substantially cylindrical surface of a yarn support, for subsequent re-use of the yarn support, comprising the steps of providing a completely annular die ring having an inner diameter corresponding to the outer diameter of the substantially cylindrical surface and having a forelip engageable with the substantially cylindrical surface; telescoping the die ring over the substantially cylindrical surface adjacent one end of the latter; effecting relative axial displacement of the die ring and a substantially cylindrical surface to cause the die ring to engage the yarn residues and reeling waste and draw the same axially beyond the opposite end of the substantially cylindrical surface to strip the yarn residues and reeling waste therefrom.

2. A method according to claim 1, including providing a resilient deformability and displaceability of the die ring forelip toward the substantially cylindrical yarn support surface, to accommodate stresses in a direction substantially parallel to the drawing direction and due to the retaining and accumulation of yarn residues and reeling waste on the forelip.

3. A method according to claim 1, including the step of, in advance of engagement of the die ring with the yarn residues and reeling waste, severing the yarn residues and reeling waste at a predetermined spacing from the substantially cylindrical surface.

4. A method according to claim 3, wherein a simultaneous cutting action is performed on the yarn loop formed on the front side of the die ring lip during the drawing action.

5. A method acoording to claim 3, including the step of performing a roughing cut and a finishing cut on the yarn residues and reeling waste at respective points spaced from and close to the die ring forelip.

6. An equipment for removing reeling waste, left on a relatively elongated substantially cylindrical surface of a yarn support, for subsequent re-use of the yarn support, comprising, in combination, retaining, sintering and fastening means removably engageable with the yarn support at locations which do not interfere with such substantially cylindrical surface; a completely annular die ring having an inner diameter corresponding to the outer diameter of the substantially cylindrical surface and having a forelip engageable with the substantially cylindrical surface upon telescoping of said die ring over the substantially cylindrical surface adjacent one end of the latter; and means operable to effect relative axial displacement of said die ring and the substantially cylindrical surface to cause said die ring forelip to slide along the substantially cylindrical surface in circumferentially complete tight engagement with the latter, to engage the reeling waste and draw the same axially beyond the opposite end of the substantially cylindrical surface to strip the reeling waste therefrom.

7. An equipment according to claim 6, wherein the fore lip of said die ring is resiliently urged toward the axis of said die ring, to reduce the drawing diameter when it is axially stressed beyond a pre-established limit.

8. An equipment according to claim 7, in which said die ring comprises an operating portion engageable with the substantially cylindrical surface and sloping axially inwardly and forwardly relative to the diametric plane of said die ring to compensate for clearances and wear of the substantially cylindrical surface.

9. An equipment according to claim 8, wherein said die ring operating portion comprises at least one inner circumferential groove defining a die ring fore lip and allowing for a motion of said lip toward the remaining die ring operating portion and toward the axis of yarn support under the essentially axial drawing stresses.

10. An equipment according to claim 9, wherein said die ring comprises at least two drawing lips made of an elastomer, said lips being designed to be successively stressed and moved toward the substantially cylindrical surface of the yarn support, for a compensation of clearances and wear.

11. An equipment according to claim 8, wherein said die ring comprises a guide, made of an antifriction material, and acting on the substantially cylindrical surface of the yarn support, downstream of the die ring, to assure a mutual axial centering of the yarn support substantially cylindrical surface and said die ring.

12. An equipment according to claim 6, comprising reeling waste cutting means, acting in advance of said die ring and cutting the reeling waste off at a predetermined distance from the substantially cylindrical surface of the yarn support.

13. An equipment, according to claim 12, in which said cutting means comprises at least one blade operable to cut the reeling waste left on such substantially cylindrical surface of the yarn support and having at least one cutting edge operable to cut the reeling waste in advance of said die ring and a further cutting edge operable to cut yarn loops formed directly in advance of the forelip of said die ring during the drawing operation.

14. An equipment according to claim 13, wherein said cutting blade is located directly in advance of the die ring fore lip and comprises a cutting edge directed toward the reeling waste to be cut, a cutting edge parallel to and spaced from the substantially cylindrical surface, and a cutting edge directed toward the die ring fore lip.

15. An equipment according to claim 13, wherein at least a roughing cut further blade is located in advanced of said one blade.

16. An equipment according to claim 15, wherein said roughing cut blade is located at a distance ranging from 60 to 150 mm in advance of said one blade.

17. An equipment according to claim 16, wherein said roughing cut blade is located at a distance of about 100 mm in advance of said one blade.

18. An equipment according to claim 13, wherein said retaining, centering and fastening means for said yarn support comprises a plurality of wedge-shaped elements axially movable from a yarn support locking position to a yarn support releasing position.

19. An equipment accordng to claim 12, including a second said die ring along with associated said waste cutting means, arranged symmetrically with said first-mentioned die ring and movable conjointly therewith to provide for a drawing operation during each stroke of relative axial displacement, in either direction, of said die rings and the substantially cylindrical surface.

20. An equipment according to claim 6, comprising a resiliently contractible die ring; and pressure responsive means operable to shrink said resiliently contractible die ring about the substantially cylindrical surface responsive to a controlled supply of a pressure fluid to said pressure responsive means.

* * * * *